United States Patent [19]

Loori

[11] Patent Number: 5,060,644

[45] Date of Patent: Oct. 29, 1991

[54] HYPERBARIC CHAMBER APPARATUS

[75] Inventor: Phillip E. Loori, Jersey City, N.J.

[73] Assignee: Ventnor Corporation, Margate, N.J.

[21] Appl. No.: 577,806

[22] Filed: Sep. 4, 1990

Related U.S. Application Data

[63] Continuation of Ser. No. 229,272, Aug. 8, 1988, abandoned.

[51] Int. Cl.[5] ..... A61G 10/00; A62B 32/00

[52] U.S. Cl. ..... 128/202.12; 128/205.26

[58] Field of Search ..... 128/202.12, 205.26

[56] References Cited

U.S. PATENT DOCUMENTS

| | | | |
|---|---|---|---|
| 911,528 | 2/1909 | Shoemaker | 128/202.12 |
| 1,224,180 | 5/1917 | Lake | 128/205.26 |
| 3,450,450 | 6/1969 | Hopkins et al. | 128/202.12 |
| 3,712,298 | 1/1973 | Snowdon et al. | 128/40 |
| 3,889,670 | 6/1975 | Loveland et al. | 128/205.26 |
| 4,003,378 | 1/1977 | Pickering | 128/205.26 |
| 4,236,513 | 12/1980 | Lo Piano | 128/40 |
| 4,296,743 | 10/1981 | Lasley | 128/40 |
| 4,335,712 | 6/1982 | Trexler | 128/205.26 |
| 4,367,728 | 1/1983 | Mutke | 128/205.26 |
| 4,481,938 | 11/1984 | Lindley | 128/205.26 |

FOREIGN PATENT DOCUMENTS

| | | | |
|---|---|---|---|
| 895442 | 1/1982 | U.S.S.R. | 128/205.26 |
| 448060 | 6/1936 | United Kingdom | 128/205.26 |

*Primary Examiner*—Edgar S. Burr
*Assistant Examiner*—Kimberly L. Asher
*Attorney, Agent, or Firm*—Lerner, David, Littenberg, Krumholz & Mentlik

[57] ABSTRACT

A hyperbaric apparatus for the hyperbaric application of therapeutic gases is provided which consists of a generally integral housing which defines an internal chamber. This generally integral housing includes several openings. Removable closures are provided for removable attachment to the housing for the sealing of each of these openings. One such closure includes a limb introduction and sealing mechanism. Also provided are gas inlet and outlet mechanisms connected to the housing for the introduction, control and maintenance of therapeutic gases within the internal chamber of the housing.

7 Claims, 5 Drawing Sheets

HYPERBARIC CHAMBER APPARATUS

This is a continuation of application Ser. No. 07/229,272 filed Aug. 8, 1988, now abandoned.

FIELD OF THE INVENTION

The present invention relates to hyperbaric apparatus and, more particularly, to hyperbaric apparatus which are portable and adapted for use in connection with the treatment of human arms and legs.

BACKGROUND OF THE INVENTION

Hyperbaric apparatus are devices which create sealed and pressurized environments for the treatment of lesions and wounds on a patient's body. Hyperbaric chamber treatment promotes healing in various ways. Specifically, it has been discovered that the hyperbaric treatment of lesions and wounds, in conjunction with various stimuli, promotes granulation, raises the capillary blood $pO^2$, reduces edema, elevates the redox potential and suppresses bacterial proliferation. It has been determined that pulsating pressure in the range of 5–50 mm Hg over a cycle of 15 seconds and gas flow rates of 10 liters per minute are most effective. It has also been found that the humidification of the hyperbaric environment during operation produces positive results.

When hyperbaric apparatus were first introduced they encompassed the patient's entire body. As time progressed, hyperbaric apparatus became more sophisticated, and portable hyperbaric apparatus were developed. Generally, portable hyperbaric apparatus include hyperbaric chambers adapted for encapsulating only a small portion of the patient's body, such as an arm or a leg.

However, as portable hyperbaric apparatus have evolved it has become apparent that significant shortcomings continue to exist. Thus, the prior art portable hyperbaric apparatus are generally of unnecessarily complex construction, difficult to apply, and unreliable. Specifically, the prior art devices have generally utilized coacting casing or housing halves, i.e. a top portion and a bottom portion which surround the limb introduced. In other words, the patient to be treated would place the limb to be treated on top of and inside the bottom half of the housing, and subsequently, the top half of the housing would be lowered on to the associated bottom half, thus enclosing the patient's limb. These housing halves are usually interconnected using latches placed at intervals along the interconnecting edges of the halves. Therefore, every time the attending medical care worker wished to maneuver the patient's leg, apply medication, or the like, it was necessary for the entire apparatus to be disassembled and subsequently reassembled.

This complexity of operation is exacerbated by the overly complex limb engagement and internal chamber sealing mechanism which has heretofore been utilized. This engagement mechanism has been adapted to fit between the corresponding halves and must be held in place accurately while the corresponding halves are aligned. Often, such alignment is not perfect and the application process must be repeated by the attending health care operator.

The instant invention solves these problems by providing a simply constructed and easy to apply and use portable hyperbaric apparatus. Additionally, the instant invention allows easy access to the limb being treated within the sealed chamber. These and other benefits of the instant invention will become apparent as the invention is more fully described below.

BRIEF SUMMARY OF THE INVENTION

In accordance with one aspect of the present invention, an improved hyperbaric apparatus has a generally integral housing which defines an internal chamber. This housing includes an opening for the introduction of the limb to be treated. A closure is provided for sealing this opening when the device is in use and correspondingly serves to seal the internal chamber. This closure includes a limb introduction flexible sealing member operatively connected to the housing. This flexible member defines a limb introduction opening. A suitable mechanism maintains and controls the therapeutic gas that is being used to treat the patient's limb.

It is the principal object of the present invention to provide an improved portable hyperbaric apparatus having a generally integral construction which defines a treating chamber into which a limb can be easily introduced, manipulated and treated.

It is another object of the present invention to provide an improved portable hyperbaric apparatus which has at least one opening for introducing a limb into the treating chamber and at least one other opening for providing access to the limb being treated.

It is still another object of the present invention to provide an improved portable hyperbaric apparatus which has at least one opening for introducing a limb into the treatment chamber, and a removable closure for that opening in which a flexible sealing assembly is formed for sealing the limb being treated in the treatment chamber.

It is still another object of the present invention to provide an improved hyperbaric apparatus having a treating chamber for a limb to be treated in which suitable means for introducing, maintaining and controlling therapeutic gases are provided.

It is still another object of the present invention to provide an improved hyperbaric apparatus which is portable and therefore expands the field of use of these devices.

It is still another object of the present invention to provide an improved hyperbaric apparatus which is simple to fabricate and therefore relatively cheap to manufacture.

For further objects and advantages and a more complete understanding of the present invention, reference is made to the following detailed description of an exemplary embodiment considered in conjunction with the accompanying drawings in which:

DETAILED DESCRIPTION OF THE PREFERRED EMBODIMENT

Figure 1:
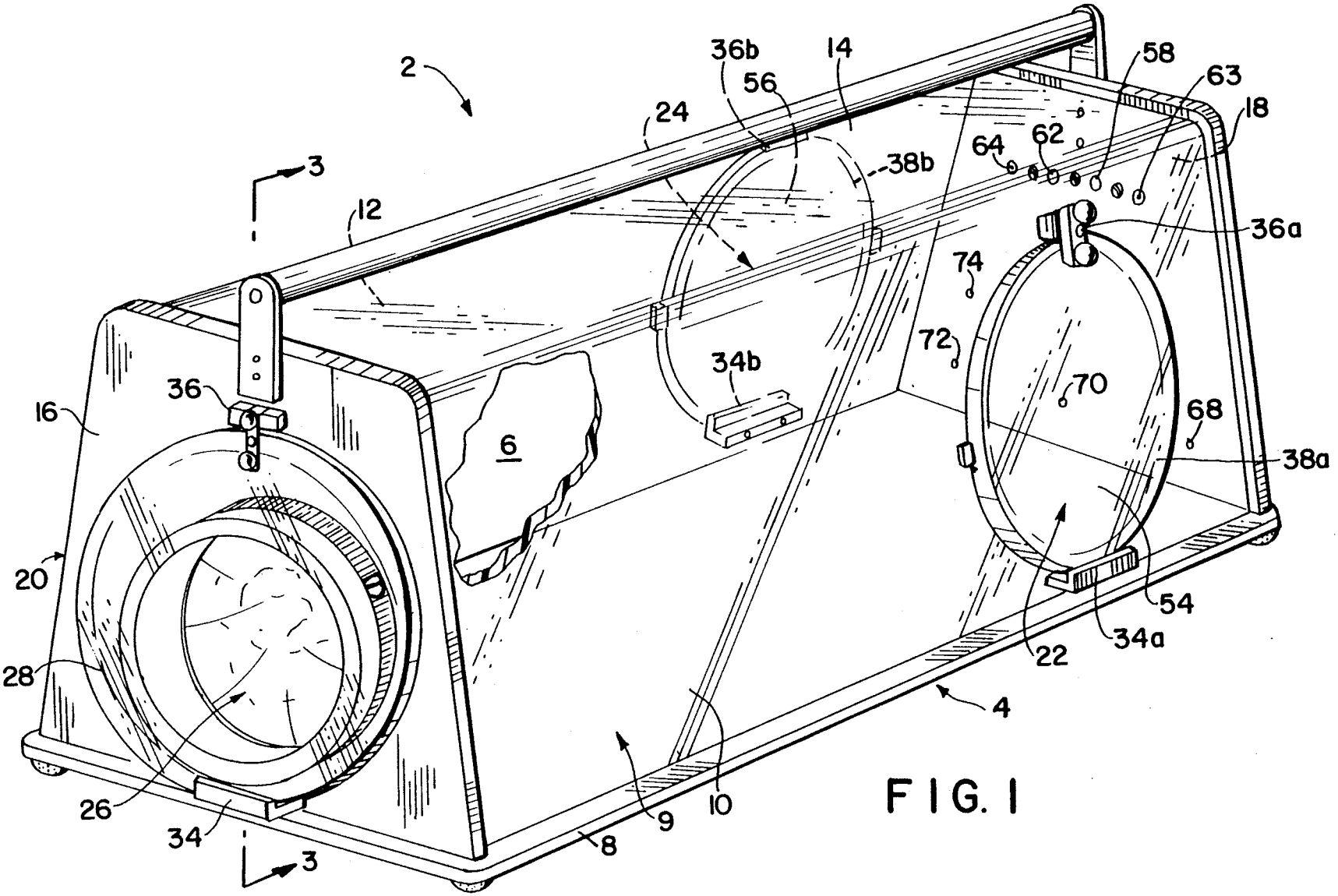
FIG. 1 is a front perspective view of the hyperbaric apparatus in accordance with the present invention partly broken away to show the internal chamber.

Referring now to the drawings, there is shown a preferred embodiment of a hyperbaric apparatus generally designated 2 in accordance with the present invention. Hyperbaric apparatus 2 includes, a generally integral housing 4 which defines an internal chamber 6. Housing 4 is generally elongated and rectilinear in shape, although those skilled in the art would readily recognize that housing 4 may have any desired shape to accomplish the purposes and objects of the present invention.

Figure 2:
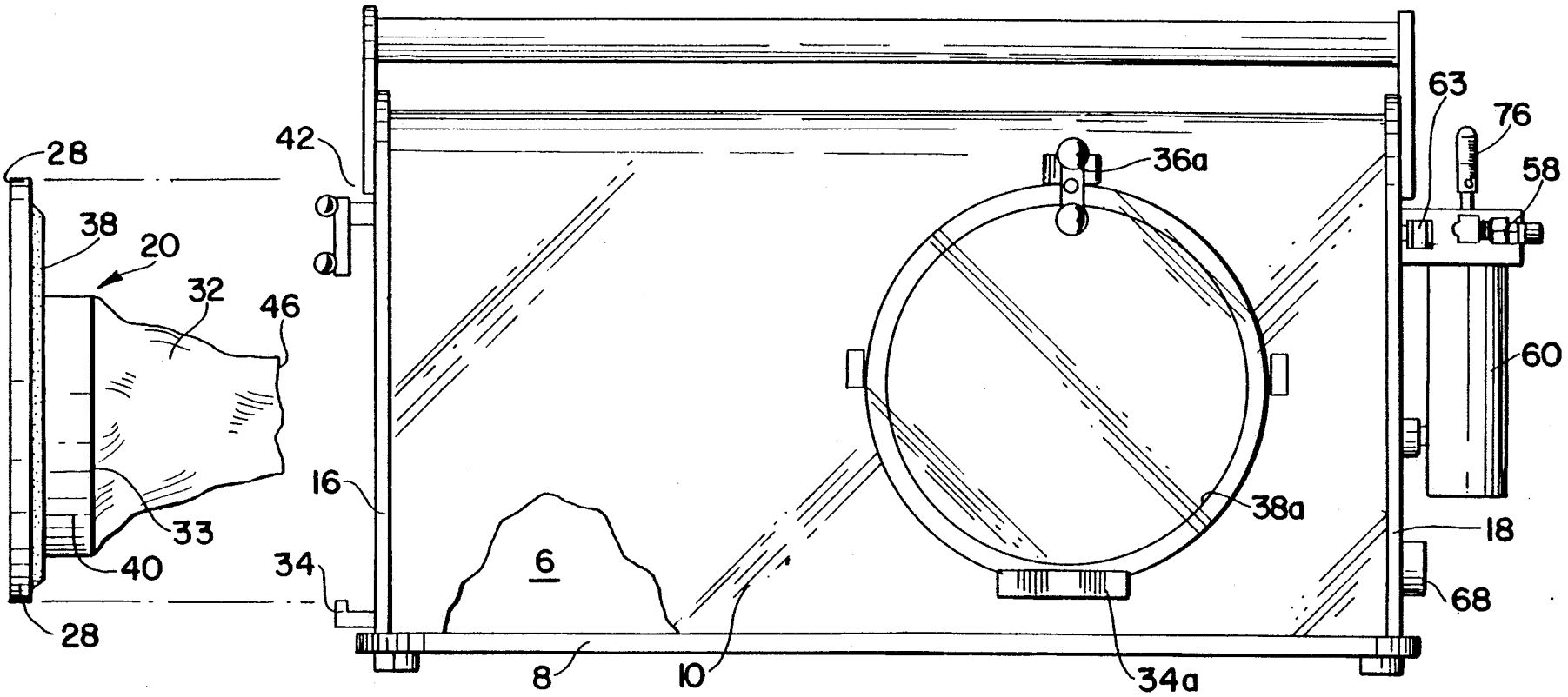
FIG. 2 is a side view of the hyperbaric apparatus in accordance with the present invention with the closure including the limb introduction mechanism disposed in spaced relation from the housing and partly broken away to show the internal chamber.
Figure 6:
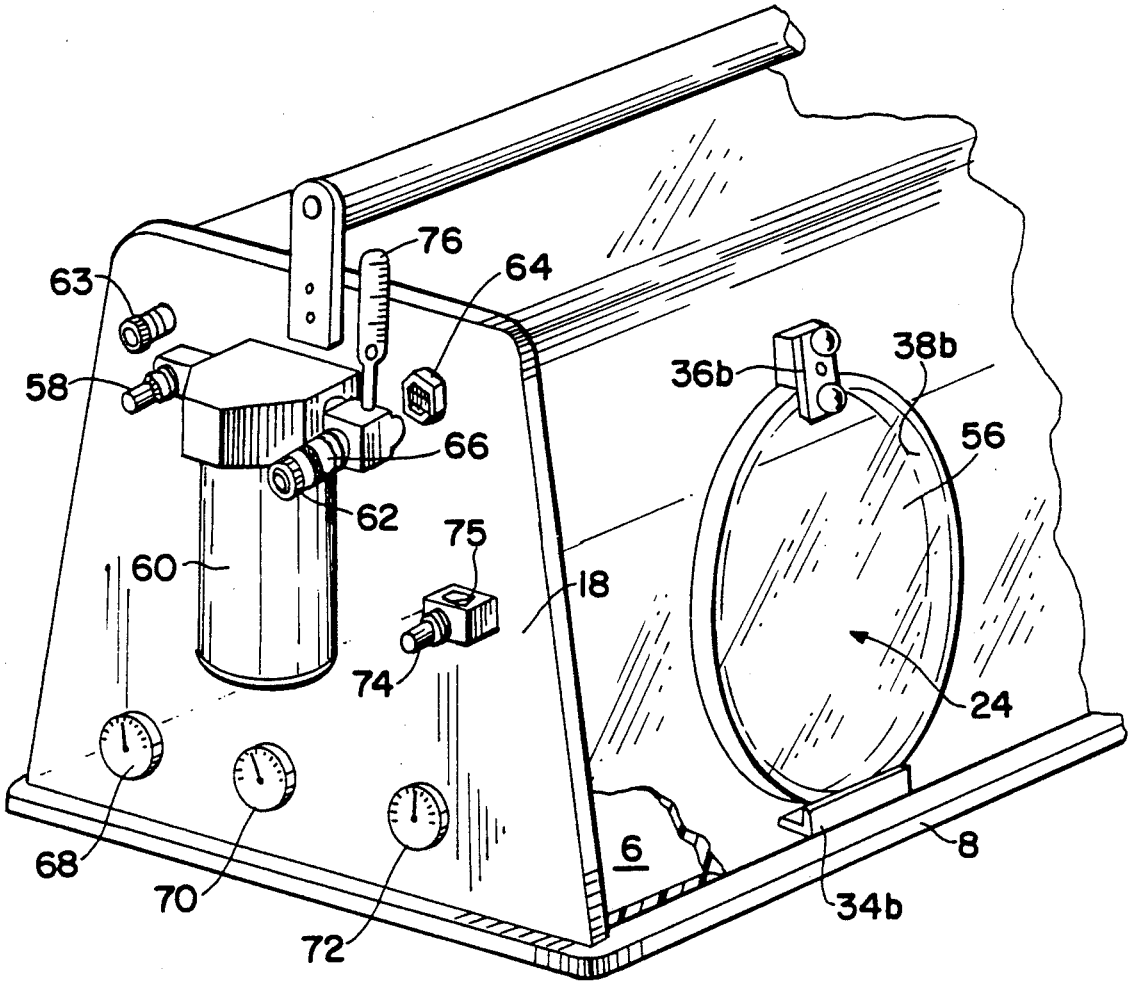
FIG. 6 is a partial rear perspective view of the hyperbaric apparatus in accordance with the present invention broke away to show the internal chamber.

Housing 4 includes a base member 8 made of transparent material. Connected to the base member 8 is an inverted U-shaped member 9, also made of a transparent material, which forms spaced side walls 10 and 12 and a top portion 14. The ends of the inverted U-shaped member 9 of the housing 4 are closed at the respective ends by end walls 16 and 18. Base member 8, inverted U-shaped member 9 defining the side walls 10 and 12 and the top portion 14, and end walls 16 and 18 form the generally integral housing 4 and define the internal chamber 6, all of which is shown in FIGS. 1, 2 and 6 of the drawings. The housing 4 is integral in the sense that base member 8, inverted U-shaped member 9, defining the side walls 10 and 12, the top portion 14, and end walls 16 and 18 are generally inseparable in assembled position.

In order to provide access to internal chamber 6 there is a limb introduction assembly 20 and an opening 26 in the end wall 16 for the limb to be treated; and access opening 22 and 24 in the respective side walls 10 and 12.

FIGS. 1, 2, 3 and 4 show that limb introduction assembly 20 disposed on end wall 16 includes an opening 26 and a removable closure 28 connectable to housing 4 to seal the opening 26. Removable closure 28 has a limb introduction opening 30 formed therein with operatively associated and elongated resilient tubular element or sleeve 32 for the introduction and sealing of the limb to be treated within internal chamber 6.

Removable closure 28 and opening 26 have a circular shape with removable closure 28 having a diameter greater than that of opening 26. Removable closure 28 is attached to end wall 16 by an L-shaped flange 34, for the reception of removable closure 28, and a fastening mechanism, such as pivotable latch 36. Both L-shaped flange 34 and pivotable latch 36 are attached to end wall 16 and adapted for securely connecting removable closure 28 to end wall 16. Pivotable latch 36 may be pivoted either clockwise or counter-clockwise in order to engage or disengage removable closure 28. Pivotable latch 36 allows removable closure 28 to be easily engaged and disengaged at will from end wall 16.

Figure 3:
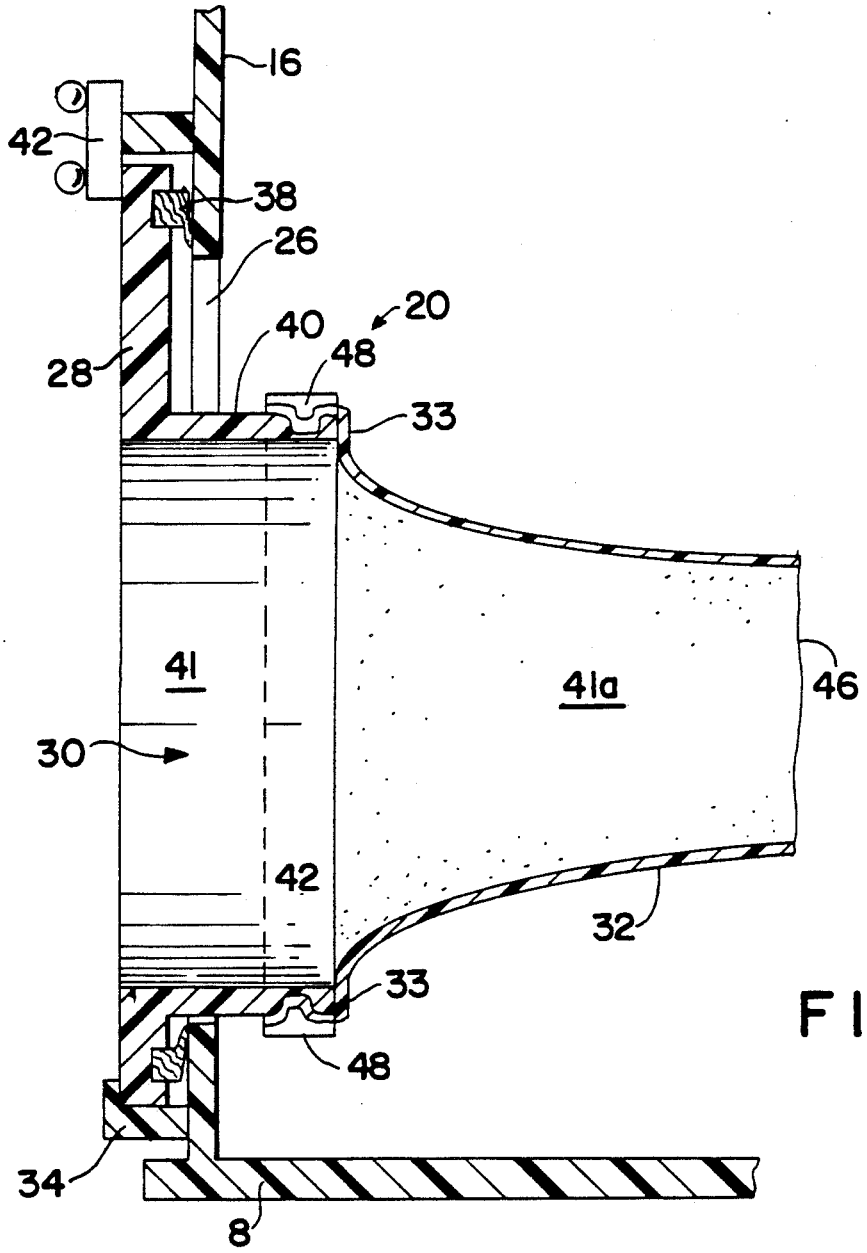
FIG. 3 is an enlarged partial cross-sectional view taken along lines 3—3 of FIG. 1.
Figure 3A:
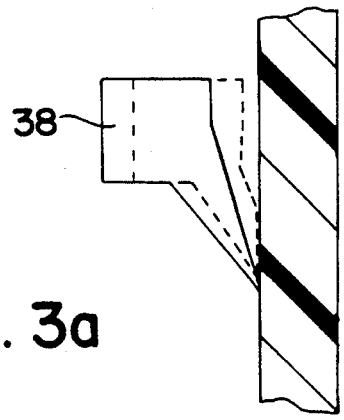
FIG. 3A is an enlarged partial cross-sectional view of the portion of FIG. 3 showing the annular sealing ring in assembled position.

An annular sealing ring 38 is disposed about that portion of removable closure 28 which extends beyond opening 26 in end wall 16. Annular sealing ring 38 has a feathered flange construction which is inwardly oriented and tapered to a relatively narrow tip. Annular sealing ring 38 is constructed in this way in order to create a seal against the end wall 16 of the housing 4 which will be reinforced when internal chamber 6 is pressurized, as best seen in FIG. 3A. The dotted line of FIG. 3A represents annular sealing 38 in an engaged position when the internal chamber is pressurized; while the solid line represent annular sealing ring 38 in an engaged position when the internal chamber is not pressurized.

Removable closure 28 includes an annular projection 40 protruding from limb introduction opening 30 into internal chamber 6. Annular projection 40 has a first end which lies in the plane of removable closure 28 and a second end which is disposed in spaced relation from removable closure 28 and protrudes within the internal chamber of housing 4. Annular projection 40 is a hollow cylinder which forms an inner channel 41 which is continuous with second opening 30. The outer wall of annular projection 40 is provided with a circumferential groove 42 proximate the second end of annular projection 40. Circumferential groove 42 provides means for connecting a first end 33 of the elongated resilient sleeve 32.

Resilient sleeve 32 is hollow and forms an inner channel 41*a*, which, in assembled position, is continuous with inner channel 41. Resilient sleeve 32 may be made of any non-permeable flexible material, such as latex. Resilient sleeve 32 tapers from the first end 33 connected with annular projection 40 to a sealable orifice 46 at the end opposite said first end 33. Resilient sleeve 32 thus defines a continuation of channel 41 projecting into internal chamber 6 and which terminates at sealable orifice 46. Thus, in assembled position, when a limb is introduced through channel 41, channel 41*a* and sealable orifice 46, it will be introduced into internal chamber 6. Further, because of the resilient nature of resilient sleeve 32 the limb so introduced will be sealed at the sealable orifice 46, all of which is shown in FIGS. 1, 2, 3 and 4.

An independent reinforcing belt 48 is provided about resilient sleeve 32 where resilient sleeve 32 engages annular projection 40. Independent reinforcing belt 48 reinforces the seal obtained by the engagement of resilient sleeve 32 with circumferential groove 42 about annular projection 40. Independent reinforcing belt 48 counteracts the forces created by the introduction, adjustment and manipulation of the limb being treated.

Figures 4, 5, 5A:
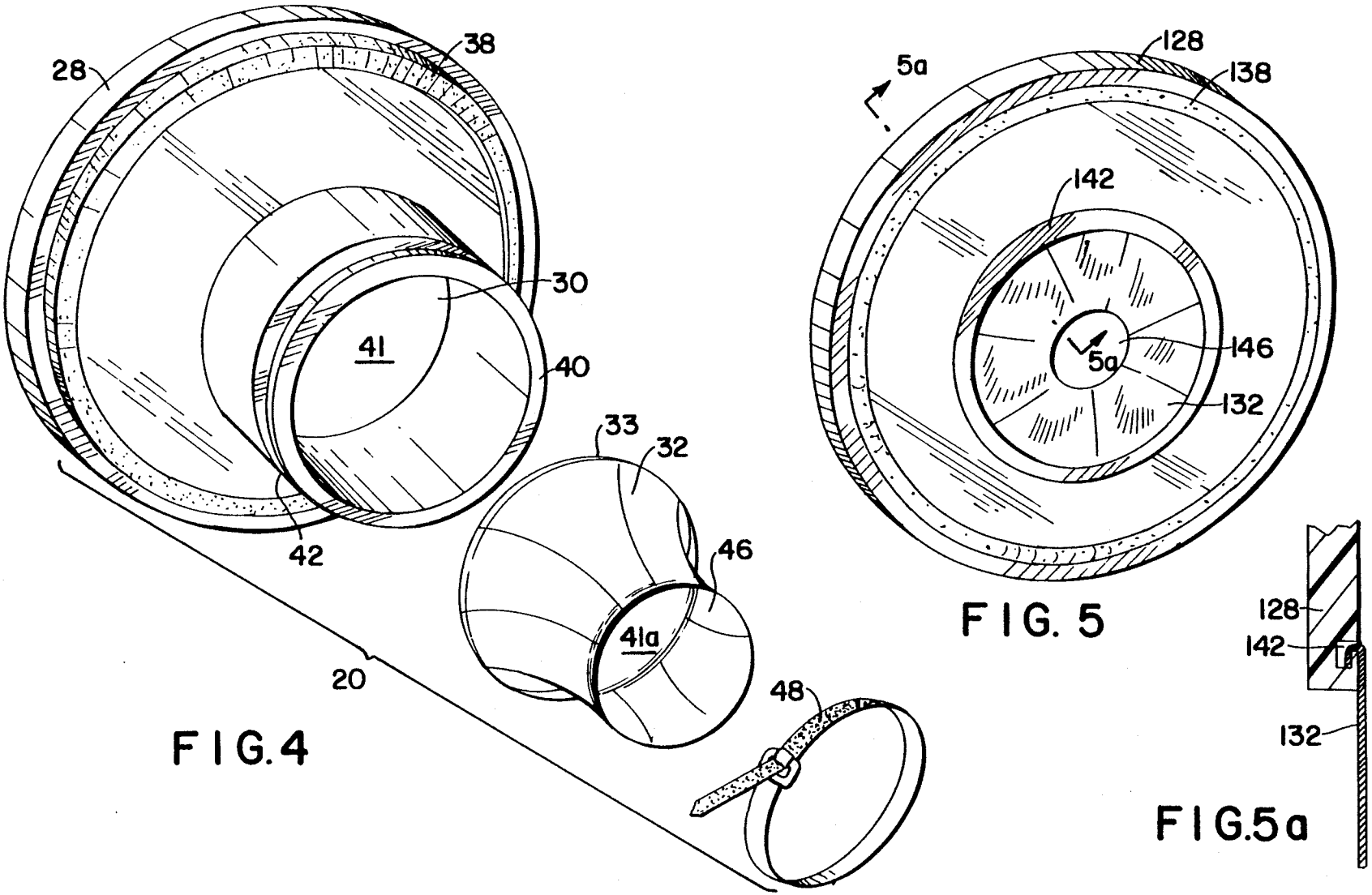
FIG. 4 is a perspective view of the closure including the limb introduction mechanism.
FIG. 5 is a perspective view of the closure with an alternate embodiment of the limb introduction mechanism.
FIG. 5A is an enlarged partial cross-sectional view of the alternate embodiment of the limb introduction mechanism taken along line 5A—5A of FIG. 5.

FIGS. 5 and 5A disclose another removable closure 128 which has an alternative embodiment of the limb introduction mechanism, generally designated 120. Removable closure 128, unlike closure 28, rather than utilizing an annular projection in conjunction with a resilient sleeve, uses a planar latex flexible member 32 which is directly connected by its outer periphery to removable closure 128, while its inner periphery forms a sealable orifice 146. Thus, the outer periphery of planar latex flexible member 132 is sealably connected in circumferential groove 142 in removable closure 128.

It is desirable during the introduction of the limb to be treated and during actual treatment that the attending health care worker have access to the internal chamber and the limb within. For this purpose, side wall access openings 22 and 24 are provided in respective side walls 10 and 12.

Operatively associated with the side wall access openings 22 and 24 are side wall closures 54 and 56 which serve to close and seal side wall openings 22 and 24 when in assembled position. Side wall access openings 22 and 24 and side wall closures 54 and 56 are circular in shape with side wall closures 54 and 56 having a diameter respectively greater than that of their associated opening. For purposes of attaching side wall closures 54 and 56 in assembled position, side walls 10 and 12, similar to end wall 16, are provided with L-shaped flanges 34*a* and 34*b* and pivotable latches 36*a* and 36*b* operating in the same way as L-shaped flange 34 and pivotable latch 36 disposed on end wall 16. Thus the side wall closures 54 and 56 are attachable and removable at will by the attending health care worker, all of which is shown in FIGS. 1,2 and 6 of the drawings.

Similar to removable closure 28, side wall closures 54 and 56 are provided with respective annular sealing rings 38*a* and 38*b*. Annular sealing rings 38*a* and 38*b* have the identical shape and function of the above-described annular sealing ring 38. Therefore, when the side wall closures 54 and 56 are in assembled position they serve to seal the associated side wall openings 22 and 24 and to prevent the escape of therapeutic gases which have been introduced into the internal chamber 6 as will be more fully described below.

When housing 4 is in assembled position, with removable closure 28 in place and a limb introduced through resilient sleeve 32 and sealed by sealing orifice 46, and when side wall closures 54 and 56 are in place, a substantially sealed internal chamber 6 is provided. Therapeutic gases at pressures above atmospheric pressure will then be introduced into this substantially sealed internal chamber via the gas inlet 58 of the present invention.

Connected to end wall 18 is a therapeutic gas inlet 58 which communicates with internal chamber 6. Gas inlet 58 may be modified by attaching a well known and readily available multiple inlet port unit, not shown, by means of which a plurality of different gas may be simultaneously introduced into the internal chamber 6. Additionally, a vaporization mechanism 60 which is connected to gas inlet 58 may be used to humidify the therapeutic gases being introduced through gas inlet 58. This vaporization mechanism 60 may also be used to introduce other solutions, such as antibiotics, in vapor form. These therapeutic gases, or enhanced therapeutic gases, will then be introduced into internal chamber 6 above atmospheric pressure and thus pressurize internal chamber 6.

Coacting with inlet 58 and also connected to end wall 18, are outlets 62 and 63. The therapeutic gases introduced through inlet 58 are discharged from the internal chamber 6 through outlet 62. Inlet 58 and outlets 62 and 63 are attached to an apparatus which is capable of controlling a substantial number of parameters of the gases introduced.

In the alternative, the present invention provides self-contained elements for the maintenance and control of the environment within the internal chamber 6. Thus, the present invention includes a well known pressure release valve 64 and a well known manually adjustable flow regulation mechanism 66 also connected to end wall 18. Pressure release valve 64 and flow regulation mechanism 66 are also in communication with internal chamber 6 and are capable of insuring that the pressure within internal chamber 6 does not exceed a predetermined limit and that a predetermined flow of therapeutic gas is maintained. The present invention also provides connected to end wall 18 and in communication with internal chamber 4 internal environment metering means; specifically, a well known pressure meter 68, a well known pressure pulsation meter 70, a well known barometer 72 and an auxiliary port 74 for the connection of any other internal chamber metering device and a well known flow meter 76. Auxiliary port 74 includes a sealing valve 75 for sealing the communication between auxiliary port 74 and internal chamber 6.

OPERATIONS

In the operation of the hyperbaric apparatus 2 in accordance with the instant invention removable closure 28 is first removed. The limb to be treated is then inserted through the limb introduction opening 30, the annular projection 40 and the resilient sleeve 32. This is done simply by sliding the removable closure up the patients' limb. The patients' limb is then inserted into the opening 26 in the end wall 16 of the housing 4 and correspondingly, into the internal chamber 6 of the hyperbaric apparatus 2 in accordance with the present invention. This is done by lifting the patients' limb and sliding the entire housing 6 in the longitudinal line of the length of the limb until the end wall 16 of the housing engages the removable closure 28. The closure 28 is then rested upon L-shaped flange 34, pressed into position until the sealing ring 38 is in engagement with the end wall 16 and then secured by the pivotable latch 36.

At this time, if the patients' limb needs to be maneuvered or, if therapeutic dressings or the like need to be applied, side wall closures 54 or 56, which ever is more convenient, will be removed and the attending health care worker will have access through side wall openings 22 and 24 to the limb introduced. When such treatment or manipulation is completed, and the patients' limb is in the desired position, these side wall closures 54 and 56 are reattached by means of their respective L-shaped flanges 34*a* and 34*b* and secured to the corresponding side walls by pivotable latches 36*a* and 36*b*, thus sealing side walls 10 and 12. A substantially sealed internal chamber with the patients' limb therein is thus produced and the treatment of that limb may then be commenced.

Therapeutic gas under pressure is now introduced into the internal chamber 6 through the inlet 58 on the end wall 18 of the hyperbaric apparatus 2. Preferably, this therapeutic gas has been humidified or otherwise enhanced by the vaporization mechanism 60. Additionally, a plurality of therapeutic gases may be introduced through inlet 58 if such a combination of gases is indicated by the treatment regimen in accordance with the treating physicians instructions.

The internal parameters of this now pressurized internal chamber may be maintained by an independent control apparatus, or in the alternative, may be maintained by the instant inventions, maintenance and control mechanisms, i.e., pressure relief valve 64 and flow regulation mechanism 66. In this regard, all that is actually needed to operate the instant invention is a pressure adjustable source of oxygen or other therapeutic gas.

While the control mechanism is illustrated as associated with the outlet 62, those skilled in the art will readily recognize that other forms of control can be utilized without the parting from the scope of the present invention.

As thus described, the present invention is an easily applied hyperbaric apparatus of simple construction, which includes an efficient method of sealing the internal chamber. This improved construction and method of sealing produce numerous beneficial end results, such as easier application and operation by the attendant health care worker. This simplified construction also improves the portability of the hyperbaric apparatus as described above.

The instant invention through the use of a unique introduction and sealing mechanism, presents a device which is much simpler to apply and use than the prior art. Specifically, the generally unitary construction of the instant invention overcomes the problems incident to two piece construction, i.e. the prior art's associated casing halves or housing assembly. It is to be noted that the hyperbaric apparatus in accordance with the instant invention includes in this preferred embodiment not only a simplified housing construction, bit also an improved sealing construction. This sealing construction is a removable closure which includes a flexible tubular member which fits and stretches about the limb to be treated by conforming about the outer periphery of that limb. This flexible member, in its preferred embodiment, is a sleeve, which protrudes at least partially within the internal chamber. The seal achieved by this flexible and resilient sleeve is improved when the internal chamber is pressurized as a result of the pressure pressing down upon that part of the flexible member protruding into the internal chamber.

Greatly increasing the ease of operation of this flexible member is its availability in various sizes and the ease with..which it can be connected about the removable closure 28 and around the patient's limb. In other words, if a child's arm were to be treated, a flexible member with a relatively narrow sleeve and relatively narrow sealing orifice would be utilized. In the alternative, if a leg were to be treated, a flexible member with a relatively wide sleeve and relatively wide sealing orifice would be provided. Similarly, in an the alternative embodiment, as shown in FIGS. 5 and 5A, a relatively narrow sealable orifice may be provided which is sufficiently flexible to encompass a large range of limbs to be introduced.

The hyperbaric apparatus in accordance with the instant invention, as above described, is also easy to operate. The preferred embodiment of the instant invention is substantially transparent so that the limb being treated is viewable at all times. Further, because the closures 28, 54 and 56 can be easily removed, this allows the health care worker easy access to the patient's limb for either manipulation of the patient's limb or the application of therapeutic dressings, etc.

The present invention additionally provides internal environment metering means as an integral element, rather than depending upon external metering apparatus. The present invention provides easy and efficient to use inlet and outlet mechanisms. These mechanisms include quick connect and disconnect couplings, pressure release fail-safe mechanisms, vaporization mechanisms and multiple therapeutic gas introduction ports. Beyond the present invention, all that is required in order to administer a hyperbaric treatment will be a pressure variable source of oxygen or other therapeutic gas as may be required.

The instant invention is also extremely portable because there are very few separate parts. The instant device is unlikely to arrive for use missing an element and is accordingly highly "field ready". This high degree of portability, ease of use and self-containment are very likely to increase the use of hyperbaric apparatus generally. Accordingly, the reluctance associated with using a complicated machine will be diminished by the present invention. As a result, individuals who previously went without such treatment may now be able to receive the most modern and up-to-date health care.

Another result of the simplicity of the present invention is a lower manufacturing cost. This will decrease end user cost and conversely, increase the use of such devices. This will enable many patients, who in the past were unable to afford such treatment, to now receive the proper care and therapy.

Although the invention herein has been described with reference to a specific embodiment, it is to be understood that this embodiment is merely illustrative of the principles and applications of the present invention. More specifically, it is to be understood that the embodiment, as represented in the detailed description of the present invention, is that embodiment which the inventor presently believes to be preferred. It is to be understood that numerous modifications may be made to this illustrative embodiment and that other arrangements may be devised from the spirit and scope of the present invention as defined by the appended claims.

What is claimed is:

1. A hyperbaric apparatus comprising: housing means defining a treating chamber, means on said housing means for introducing a limb to be treated into said treating chamber, said means for introducing a limb into said treating chamber including first removable closure means having an exterior surface and removably connected to said housing means, at least one access means on said housing means a spaced distance from said means on said housing means for introducing a limb to be treated and operative for communication with said treating chamber, said access means including second removable closure means having an exterior surface and removably connected to said housing, said first and second removably closure means each supporting an annular sealing ring for sealing said first and second removable closure means to said housing means, first attachment means for operatively and removably attaching said first removable closure means to said housing means, second attachment means for operatively and removably attaching said second removable closure means to said housing means, said first attachment means comprising a non-moveable first L-shaped flange means attached to said housing means for engaging said exterior surface of said first removable closure means at a first location and first pivotable latch means spaced from said first L-shaped flange means at a second location for providing a sealed removable connection of said first removable closure means to said housing means by engagement with the exterior surface of said first removable closure means at said second location, said second attachment means comprising a non-movable second L-shaped flange means attached to said housing means for engaging said exterior surface of said second removable closure means at a first location and second pivotable latch means spaced from said second L-shaped flange means at a second location for providing a sealed removable connection of said second removable closure means to said housing means by engagement with the exterior surface of said second removable closure means at said second location, sealing means for sealing said limb in said means on said housing means for introducing a limb to be treated into said treating chamber, and means connected to said housing means and communicating with said treating chamber for the introduction, regulation and control of a treating medium within said treating chamber.

2. A hyperbaric assembly as claimed in claim 1 wherein said housing means is formed as a generally integral unit.

3. The apparatus according to claim 1 wherein said housing means is formed of a relatively light material.

4. The apparatus according to claim 1 wherein said housing means is formed of a transparent material.

5. The apparatus according to claim 1 wherein said means for sealing said limb is disposed on said removable closure means.

6. A hyperbaric apparatus as recited in claim 1, further comprising said means for introducing a limb into said treating chamber including an opening, said first removable closure means having an inner surface facing the exterior surface of said housing means opposing said opening, said annular sealing ring disposed on the inner surface of said first removable closure means surrounding said opening to provide a seal between the inner surface of said first removable closure means and the exterior surface of said housing means, said annular sealing ring having an inwardly extending resilient flange, said first attachment means for operatively and removably attaching said removable closure means to the exterior of said housing means operative for compressing said resilient flange against the exterior surface of said housing means surrounding said opening to provide a compression seal thereat independent of the pressure within said treating chamber, and means for enhancing the compression seal of said first removable closure means comprising the inner surface of said removable closure means, the exterior surface of said housing means and said opening forming a passageway in communication between the interior of said chamber and said flange of said annular sealing ring, and said means for introduction, regulation, and control of a treating medium within said treating chamber introducing a positive pressure within said chamber to compress said flange against the exterior surface of said housing means to enhance the compression seal created thereat.

7. The apparatus according to claim 6, wherein said means for sealing said limb is disposed on said removable closure means.

* * * * *

UNITED STATES PATENT AND TRADEMARK OFFICE

CERTIFICATE OF CORRECTION

PATENT NO. : 5,060,644

DATED : October 29, 1991

INVENTOR(S) : Phillip E. Loori

It is certified that error appears in the above-identified patent and that said Letters Patent is hereby corrected as shown below:

Column 4, line 55, "32" should read --132--.
Column 7, line 29, delete ".." after with.
Column 8, line 38, "removably" should read --removable--.

Signed and Sealed this

Thirteenth Day of April, 1993

*Attest:*

STEPHEN G. KUNIN

*Attesting Officer*

*Acting Commissioner of Patents and Trademarks*